United States Patent [19]

Bussard et al.

[11] Patent Number: 4,884,717

[45] Date of Patent: Dec. 5, 1989

[54] NON-SPILLING SNACK CONTAINER

[76] Inventors: Janice W. Bussard, 201 N. Fruitport Rd., Spring Lake, Mich. 49456; Kelley B. Reenders, 1714 Dykhouse Ave., Grand Haven, Mich. 49417

[21] Appl. No.: 325,852

[22] Filed: Mar. 20, 1989

[51] Int. Cl.[4] ..... B65D 51/00

[52] U.S. Cl. ..... 220/229; 383/38; 383/99

[58] Field of Search ..... 220/229, 254, 339; 383/38, 80, 81, 98, 99

[56] References Cited

U.S. PATENT DOCUMENTS

| | | | |
|---|---|---|---|
| 2,555,935 | 6/1951 | Richey | 383/99 |
| 2,575,893 | 11/1951 | Seaman | 383/90 |
| 3,086,674 | 4/1963 | Scheuerman | 220/229 |
| 3,315,402 | 4/1967 | Scott | 220/229 |
| 3,656,668 | 4/1972 | Liebertz | 383/80 |
| 4,053,084 | 11/1977 | Anderson | 220/229 |
| 4,246,945 | 1/1981 | Sterling | 383/81 |
| 4,308,885 | 1/1982 | Geissler | 220/229 |
| 4,328,904 | 5/1982 | Iverson | 220/339 |
| 4,519,499 | 5/1985 | Stone | 383/38 |
| 4,750,636 | 6/1988 | Wortham | 220/229 |

*Primary Examiner*—George E. Lowrance

[57] ABSTRACT

A container used for nibbling snack food, including a receptacle and a top cover made of flexible material, the cover having crossing slits forming a circle of tongues which when flexed downwardly by a person's fingers reaching inside for picking up the food, thus form a self-closing dispensing opening through the cover.

3 Claims, 2 Drawing Sheets

NON-SPILLING SNACK CONTAINER

BACKGROUND OF THE INVENTION

1. Field of the Invention

This invention relates generally to containers used in holding of foods for human consumption. More specifically it relates to containers that are suitable particularly for dry foods which may be picked up between the fingers of a person's hand such as, for example: popcorn, shelled nuts, potato chips, dry cereal, candies, raisins or other snack food. Still more specifically, it relates to snack containers of small size from which an individual may feed himself directly.

2. Prior Art

Snack goods, usually eaten between regular meals by both adults and children, are often packaged in disposable cartons or polyethylene bags so that an individual may partake directly therefrom whether being at home, such as when watching television, or else away from home, such as while traveling in an automobile, or at a picnic, sports event, theater or the like. Eating under such conditions without the snack food being first transferred to proper serving dishes, but eating directly from the carton or bag, while at same time the mind is being distracted elsewhere, results in easy spilling of some of the food upon a floor or ground, which is objectionable. This situation is therefore in want of an improvement.

SUMMARY OF THE INVENTION

Accordingly, it is a principal object of the present invention to provide a container used for nibbling of snack food and which permits a person's fingers to reach thereinto for picking out some of the food whenever so wished, but which automatically closes itself after the fingers are removed so that no food still in the container will spill out if the container is tilted too far or accidentally tipped over.

An original and primary purpose of the invention is providing a solution to the spilling of dry food caused by a handicapped person, a toddler's underdeveloped motor skills or the unsteady movements of an oldster or bed patient.

Another object is to provide a non-spilling snack container which automatically wipes off any salt, sugar or crumbs from a back of a person's fingers while being lifted out of the container so to prevent this being scattered upon furniture, carpet, or floor.

Another object is to provide a non-spilling snack container which may be either inexpensively made so to be disposable after being emptied or else better made so to be refillable and reusable.

Yet another object is to provide a non-spilling snack container which will be ideal for use by little children who tend to be less careful against spilling as well as handicapped people or bed-ridden patients trying to snack while in reclined position.

Other objects are to provide a non-spilling snack container which is simple in design, inexpensive to manufacture, rugged in construction, easy to use and efficient in operation.

These and other objects will be readily evident upon a study of the following Specification and the accompanying Drawings.

BRIEF DESCRIPTION OF THE DRAWING FIGURES

Figure 4:
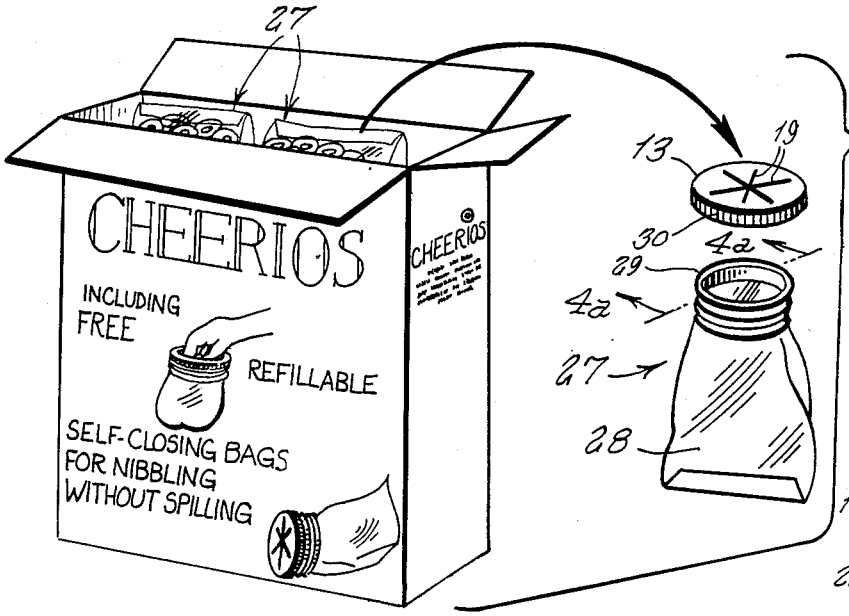
FIG. 4 is a perspective view of another design of the invention made particularly as a premium for being given away inside a box of snack food.

FIG. **4*a* is an enlarged cross-sectional view taken fragmentarily on line 4*a*—4*a* of FIG. 4**, and showing a modified design thereof.

Figure 5:
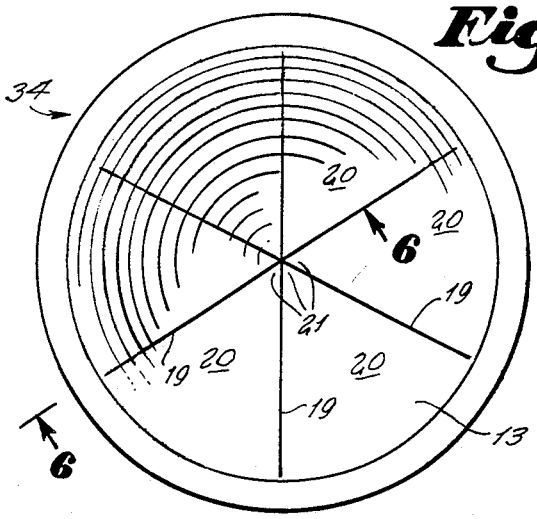

FIG. 5 is a top plan view of yet another design of the invention wherein the slotted top wall is downwardly dished; the top wall central opening being shown closed.

Figure 2:
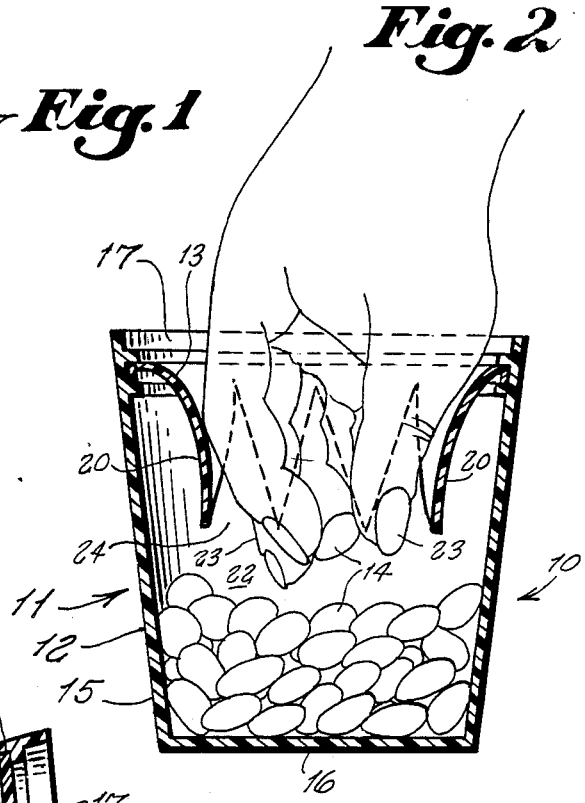
FIG. 2 is cross-sectional view of the container as viewed on line 2—2 of FIG. 1, and shown with fingers inserted thereinto.
Figure 6:
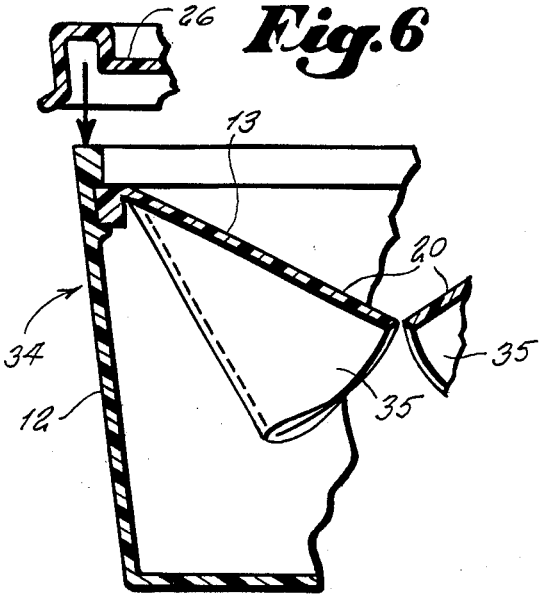

FIG. 6 is a fragmentary side cross-sectional view taken on line 6—6 of FIG. 5, and showing the edge of the top wall center opening being pleated instead toothed such as in FIG. 2.

Figure 7:
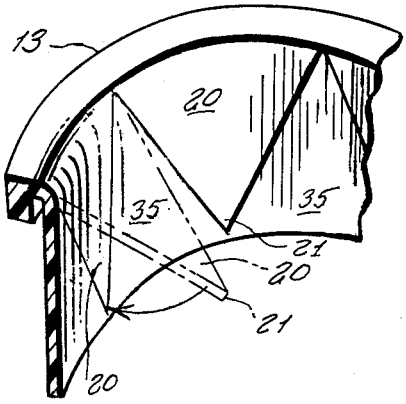

FIG. 7 is a fragmentary perspective view of the FIG. 6 top wall central opening in a spread open position.

Figure 8:
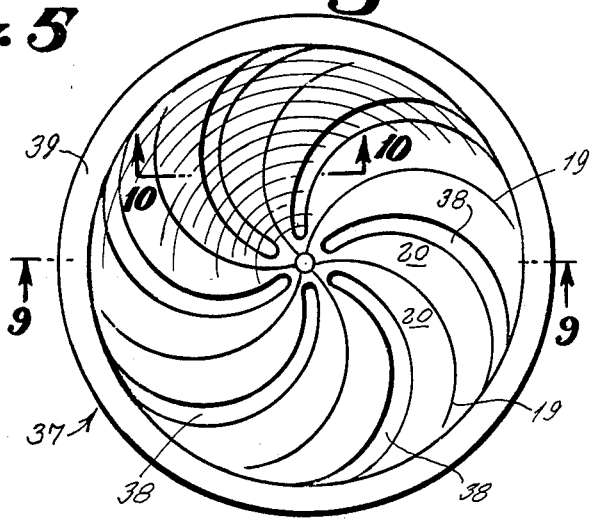

FIG. 8 is a top plan view similar to FIG. 5, and showing yet another design of the invention.

Figure 9:
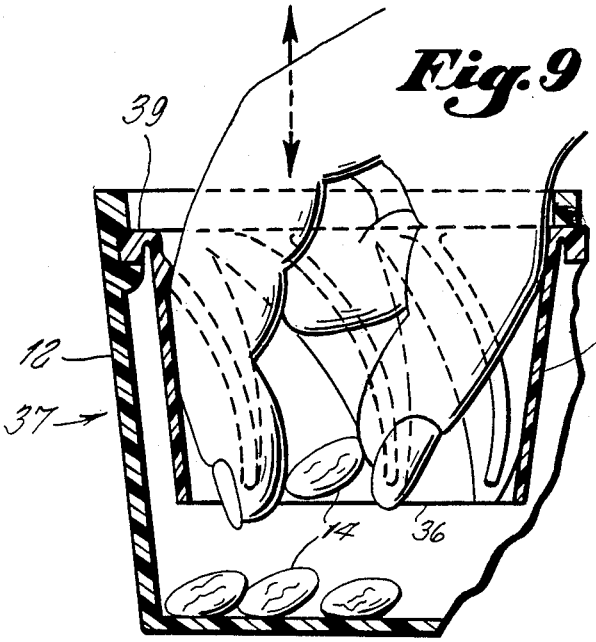

FIG. 9 is a cross-sectional view taken on line 9—9 of FIG. 8 and showing the top wall central opening spread open.

Figure 10:
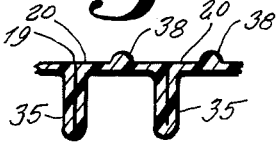

FIG. 10 is a cross-sectional view taken on line 10—10 of FIG. 8, showing the top wall pleat construction.

Figure 11:
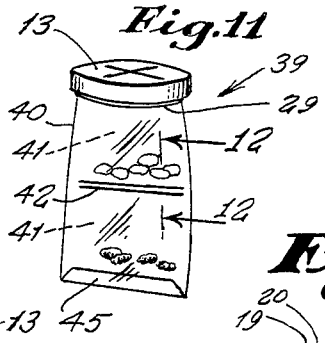

FIG. 11 is a perspective view of yet another design of the snack food package that is shown in FIG. 4.

Figure 12:
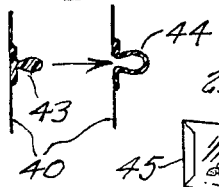

FIG. 12 is an enlarged fragmentary cross-sectional view taken on line 12—12 of FIG. 11.

Figure 13:
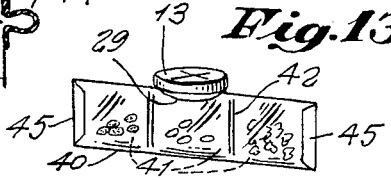

FIG. 13 is a perspective view of a further modified design of the snack food package that is shown in FIG. 11.

DETAILED DESCRIPTION OF THE DRAWING FIGURES

Figure 1:
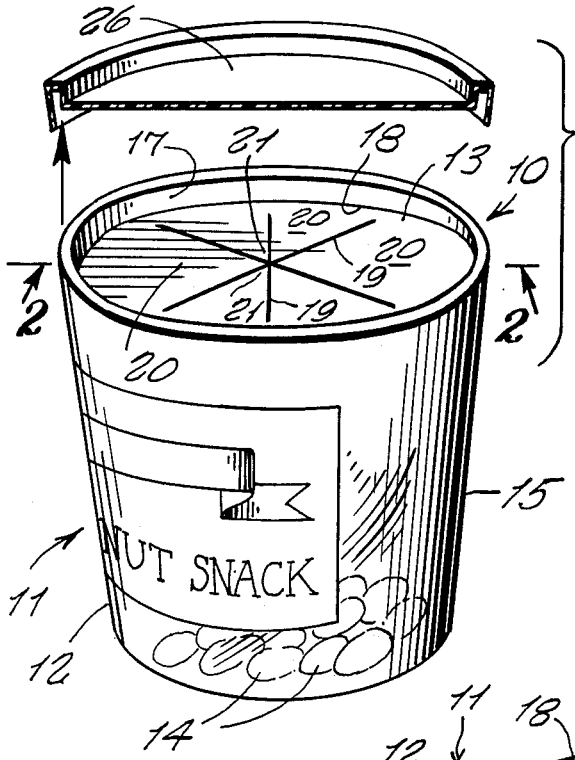
FIG. 1 is a perspective view of one design of the invention, and illustrating a cover of the container partly broken away.
Figure 3:
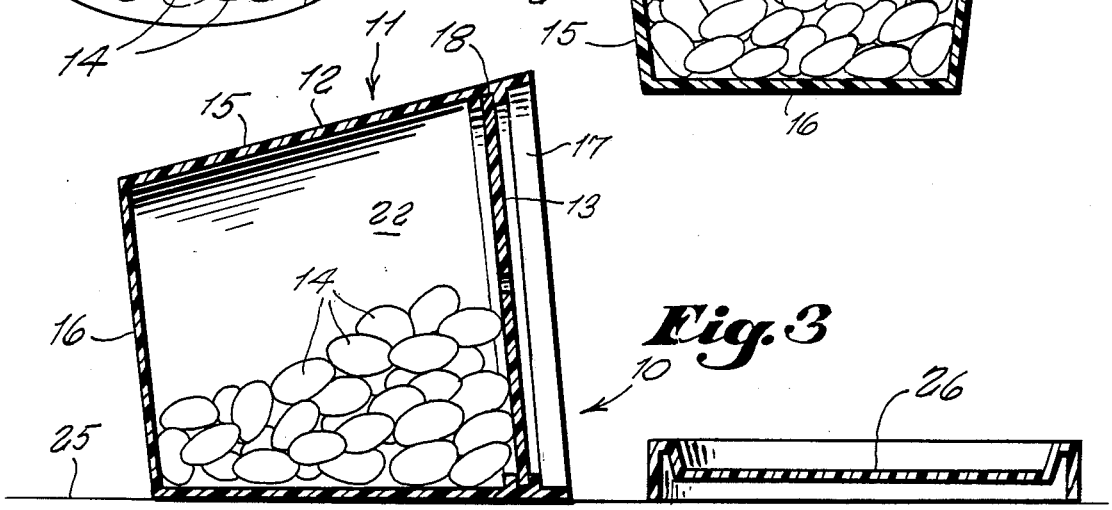
FIG. 3 is a similar cross-sectional view of the container shown tipped over onto its side.

Referring now to the drawings in greater detail, and more particularly to FIGS. 1 to 3 thereof at this time, the reference numeral 10 represents a non-spilling snack container, according to the present invention, wherein there is an assembly 11 comprised of a receptacle 12 fitted with a snapped on cover 13. The receptacle in this form of the invention is a rigid cup made preferably of transparent plastic so to permit seeing the food 14 that is contained therewithin; the cup comprising a frustoconical side wall 15 and a circular flat bottom wall 16. Near a top of an opening 17 of the cup, an annular interior groove 18 is molded for snap fitting thereinto a peripheral edge of the cover. The cover is flat, being molded either of flexible rubber or stamped of resilient plastic, as preferred by a manufacturer. A plurality of crossing slits 19 across a center of the cover serve to form a circular row of tongues 20 therebetween; a pointed end 21 of the tongues abutting together at the center of the cover. When at normal rest, the tongues close a central compartment 22 inside the receptacle, and the food is retained therein.

However, in use, when some of the food is wanted to be taken out, a person's fingers 23 are depressed down against the tongues, causing them to flex downwardly into the receptacle, as shown in FIG. 2, so to form a central opening 24 in the cover for the fingers to reach inside and pick up some of the food. After the fingers are lifted out of the opening, carrying the food, the tongues immediately flex back to the original flat position, closing the opening, so no food can spill out. Thus, even if the receptacle is dropped on a floor 25 and tipped over, as suggested in FIG. 3, there is no spill to clean up. To assure freshness being retained in any food left over inside the receptacle for long periods of time, a removable top lid 26 can be snapped over a top edge of the receptacle, the lid preventing any dust to settle upon the cover 13.

FIG. 4 illustrates another design 27 of the invention wherein the receptacle comprises a transparent, flexible, polyethylene bag 28 instead the above described rigid cup so to be still less expensive. As shown, it is enclosed as a free premium in a box of cereal into which it easily fits. A parent can fill the snack container for children directly from the box or else the food may be prepackaged by the manufacturer in several bags fitted in the box as shown in the drawing. Being inexpensive, the container may be discarded with the box when empty, and is replaced by another purchase of a box of cereal. In this design, the mouth lip of the bag is adhered to a rigid plastic collar 29 upon which the above described flexible cover 13 having closable opening 24 is removably screwed, so to allow refilling the bag. As shown in FIG. 4, the cover 13 may be downwardly flanged to fit over a top and around outer sides of the collar. A knurl 30 around the collar provides grip for easy turning.

Figure 4A:
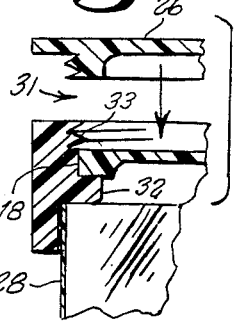

A modified design 31 of this, shown in FIG. 4*a*, includes the cover 13 fitted within a groove 18 formed between a shoulder 32 and a screw thread 33 into which the removable dust lid 26 is screwed.

Referring now to FIGS. 5 to 7, another design 34 of the invention includes a flexible rubber cover 13 snap fitted in a cup-shaped, rigid receptacle 12 and the above described removable top lid 26. In this design, the rubber cover is not flat as described above, but is downwardly dished so to catch any crumbs, salt, or sugar dropping from any food as it is being lifted by a person's fingers out from the receptacle. Additionally, each tongue 20 formed between slits 19 is joined to its each adjacent tongue by a pleated flange 35 that folds, out of sight, downwardly into the receptacle. The purpose of the flanges is to eliminate the pointed tips 21 of the tongues which might feel scratchy to a delicate skin of a hand or fingers entering the opening 24, as shown in FIG. 2. The flanges thus form a continuously circular edge 36 that feels smooth when the fingers are moved about within the receptacle and then drawn upwardly out through the opening.

Referring now to FIGS. 8 to 10, a further modified design 37 of a snack container also includes the downwardly dished concept of the cover described hereabove. However, the slits 19 extend spiral-shaped from the center of the cover 13. Additionally a raised spiral-shaped rib 38 on the upper side of each tongue extends from the cover center toward the peripheral area 39 of the cover. The above described flanges are likewise included so to form the continuous circular edge 36. In this design, when a hand or fingers are inserted in the opening to pick up food and are then lifted vertically outward of the receptacle, the spiral ribs are drawn spirally across a back of the hand or fingers so to wipe off any crumbs, salt or sugar therefrom so to not carry it out of the receptacle. In a further design of the rib, it may be segmented along its length forming gentle spaced-apart teeth that scrape these granules from the fingers and hand.

It is to be noted, as shown in FIG. 8 of the Drawings, that the tongues are also spiral-shaped and the ribs are located along a center of the tongues, so that circumferentially each rib's opposite ends overlap the ends of adjacent ribs on next tongues. Thus the ribs extend full circle around the opening 24 so that the ribs sweep over the entire outer side of the hand or fingers moving in axial direction during withdrawal through the opening as indicated by the arrow in FIG. 9. While the inward end of each rib starts in a radial direction, its full-length curve causes it to bend at an ever-increasing diagonal angle to its opposite end. The gradually changing incline of the rib spiral permits attacking the stuck-on debris from different angles so to dislodge it, while giving a longer scrubbing action line and time than would be possible by a horizontal rib transversely to the hand or finger withdrawal axis, and also it guides the debris to drop back into the container.

Referring now to FIGS. 11 and 12, yet another design of snack food package 39, made of transparent, flexible polyethylene comprises a bag 40 that is divided into compartments 41 by means of a resealable closure 42 therebetween, so that different foods may be packaged in each, and they may be eaten either separately in sequence or mixed, as wished by either keeping the closure sealed while eating up one first or else opening it up.

The closure comprises a conventional molded rib 43 that snap fits into molded groove 44. The bag is made from a tubular stock having permanent seal 45 at one end and the collar 29 sealed at its other end retaining the slitted cover 13. FIG. 13 shows a design of this wherein the bag is longer, divided into three compartments with reclosable seals therebetween, and permanent seal at each end of the bag. The collar is attached to the center of the bag for communication with the center compartment. In this design, three different snack foods such as, nuts, raisins and Cracker Jack popcorn may be separately packaged and the one in the center compartment may be selectively mixed with either one in the endmost compartments as wished. While snacking, the food may be retained inside the center compartment by resealing the closures 42 so the food is easily reached by the fingers.

While various other changes or additions may be made in the detail construction, it is understood that these will be within the spirit and scope of the present invention as is defined by the appended claims.

What we claim as new, is:

1. A non-spilling snack container, comprising, in combination, a receptacle, a quantity of removable dry-type snack food within said receptacle, said receptacle being open at its upper end, a cover made of flexible material closing said open end, and a plurality of crossing slits across a center of said cover forming a circle of tongues, said tongues in a downwardly flexed position forming a central opening through said cover for removal of said snack food from said receptacle; said crossing slits being spiral-shaped from said crossing center so that said tongues are spiral-shaped; a raised spiral-shaped rib upon an upper side of each said tongue, said rib extending along a length of said tongue; and a pleated flange connecting between adjacent side edges of said tongues.

2. The combination as set forth in claim 1, wherein said rib is segmented along its length forming gentle, spaced-apart teeth.

3. The construction as set forth in claim 1, wherein said spiral-tongued cover is conically downwardly dished.

* * * * *